United States Patent [19]

Marschman

[11] 4,123,361

[45] Oct. 31, 1978

[54] LINT FILTER ASSEMBLY

[76] Inventor: Loren H. Marschman, 411 N. Pine, Arlington Heights, Ill. 60004

[21] Appl. No.: 801,057

[22] Filed: May 27, 1977

[51] Int. Cl.[2] ..... B01D 25/08

[52] U.S. Cl. ..... 210/232; 210/463

[58] Field of Search ..... 210/134, 232, 315, 448, 210/449, 460, 463, 484, 459

[56] References Cited

U.S. PATENT DOCUMENTS

| | | | |
|---|---|---|---|
| 2,562,328 | 7/1951 | Null | 210/459 X |
| 2,754,003 | 7/1956 | Fenner | 210/134 |

FOREIGN PATENT DOCUMENTS

| | | | |
|---|---|---|---|
| 1,220,112 | 1/1960 | France | 210/484 |

*Primary Examiner*—William A. Cuchlinski, Jr.
*Attorney, Agent, or Firm*—Dulin, Thienpont, Potthast & Snyder, Ltd.

[57] ABSTRACT

A filter assembly for removing lint from water discharged through a hose from a washing machine comprised of an elongate tubular housing, an elongate tubular filter element located within the housing, and a filter removal element with a section underlying the filter element adjacent the end of the body opposite the hose and an elongate stem extending therefrom through the filter element to adjacent the inlet end. The stem is manually accessible through the inlet end of the body for withdrawal of the removal element therefrom, and when withdrawn, the underlying section carries the filter element out of the housing. The underlying section substantially closes the end of the housing opposite the hose to block the flow of water therethrough. The stem is threadably connected to the center of a connector plate which, in turn, is threadably connected to the body at its open end, and a center projection thereon projects from the open end to facilitate manual removal. The filter element is resilient and slit along its length to facilitate cleaning.

8 Claims, 5 Drawing Figures

12
14
10
18
20
22

14
32
54
30
56
28
50
26
48
44
36
34
24
42
40
38

32
64
50
52
36
64
62
34
24
4
4
70
40
42
70
26
28
70
44
68
38

58
34
60
62
30
52
24
54
62
60

28
28
W
42
38

LINT FILTER ASSEMBLY

BACKGROUND OF THE INVENTION

This invention relates generally to a filter and, more particularly, to a filter assembly for removing lint from water discharged through a hose from a washing machine.

Conventional clothes washers or washing machines are provided with a rubber discharge hose through which the soapy water employed in the washing cycle is removed from the machine at the end of the cycle. Most washing machines have filters which collect the lint off the clothes during the washing cycle. During the discharge cycle, the internal lint filter is backflushed as the water is pumped out of the machine through the discharge hose.

The discharged water and lint carried thereby is customarily disposed of through existing sewer, sump, or other water drainage systems. A particularly common manner of disposing of the discharge water is to discharge it into a utility sink or washbasin from which the water drains through a drain and plumbing system associated therewith. The lint and other debris found in the discharge water often accumulate in and clog or plug the pipes, drains, etc., of the system. When this occurs, costly plumbing repairs frequently result.

To avoid the lint accumulation problem, a number of filters have been proposed to remove the lint from the discharge water before it can accumulate in and clog the plumbing system. A number of such filter assemblies are shown in U.S. Pat. Nos. 3,804,258; 2,754,003; 2,490,443; 2,562,328; 2,608,302; 2,809,650 and 3,487,944. Some of the filter assemblies, such as the one shown in U.S. Pat. No. 3,804,258 of Okuniewski et al. have an elongate cylindrical body with perforations along the length thereof for containing an elongate cylindrical filter element. The housings are adapted to be connected to the outlet end of the discharge hose such that the discharge water flows into the open inlet end of the housing through the filter element and radially outward through the side perforations of the housing.

A factor which has prevented the widespread use of such filters, and thus prevented a widespread solution of the lint accumulation problem noted above, is the difficulty encountered in cleaning a reusable filter element of the assembly. After a period of use, the filter element, of course, becomes clogged with lint and must be cleaned or replaced. If the filter element cannot be easily cleaned or replaced, many users simply dispense with the filter assembly.

SUMMARY OF THE INVENTION

The principle object of the present invention is the provision of a lint filter assembly of the type described above in which the filter elements may be easily and readily removed from the housing and cleaned. In accordance with this object, the lint filter assembly of the present invention is provided with a filter removal element within an elongate cylindrical housing of the assembly. The removal element has a section underlying the filter element adjacent the one end of the body spaced from the hose and an elongate stem extending therefrom through the filter element to adjacent the inlet end of the housing. The stem is manually accessible through the open end of the body for withdrawal of the removal element therefrom, and the underlying section carries the filter out of the body when the filter removal element is withdrawn.

An important feature of the filter removal element is that the underlying section which carries the filter element out of the body when the element itself is removed substantially conforms in dimension to the inside of the tubular housing whereby the one end of the housing is closed thereby. Closure of the end of the housing opposite the hose is necessary to create back pressure for causing the water to radially discharge through the filter element along the length of the housing. Thus, the filter removal element serves the dual function of facilitating removal of the filter element for cleaning and closing the one end of the housing. This eliminates the need for a separate closure.

A further advantageous feature of the lint filter assembly is the provision of a filter element which, when contained within the housing, is maintained in a substantially tubular cylindrical configuration, but which, upon being removed, resiliently returns to a planar configuration for easy cleaning.

Further features and advantages will be apparent from the following description of the preferred embodiment and the drawing.

BRIEF DESCRIPTION OF THE DRAWING

The following description of the preferred embodiment is given with reference to the several views of the drawing, in which.

DESCRIPTION OF THE PREFERRED EMBODIMENT

Figures 1, 2, 3, 4, 5:
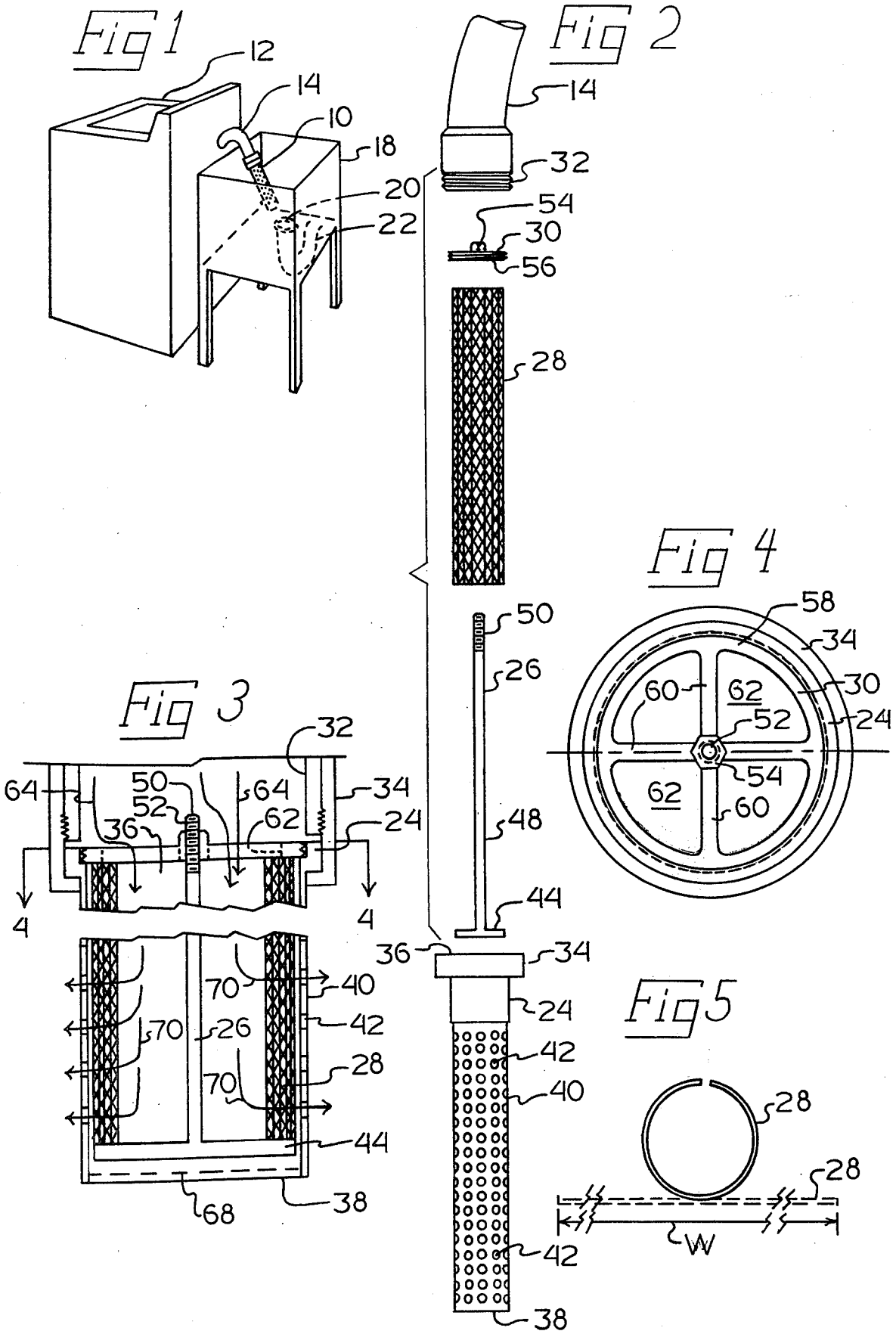
FIG. 1 is a perspective view of a washing machine employing the lint filter assembly to protect the drainage system of a utility sink.
FIG. 2 is an exploded view of the preferred embodiment of the lint filter assembly and conventional discharge hose.
FIG. 3 is a view of a section taken through the elongate axis of the lint filter assembly in assembled form as connected with the end of a discharge hose.
FIG. 4 is a sectional view taken along section line 4—4 of FIG. 3.
FIG. 5 is an end view of the resilient filter element, illustrating in solid line its cylindrical configuration when in the housing, and also illustrating, in broken line, the planar configuration which it assumes upon removal from the housing.

Referring to FIG. 1, the lint filter assembly 10 of the present invention is seen as employed with a clothes washer or other washer machine 12. At the end of a washing cycle, the lint-laden water contained within washer 12 is pumped out of the washer through a discharge hose 14 and the filter assembly 10 attached to the end thereof into a utility sink or washbasin 18. The lint is trapped by filter 10. The lint-free water flows out of the washbasin 18 through a drain opening 20 and drain pipe 22, and thereafter into the plumbing system.

Referring to FIG. 2, the filter assembly is seen to comprise a filter housing or body 24, a filter removal element 26, a filter or filter element 28 and a threaded connector plate 30 for releasably securing filter removal element 26 to housing 24. Hose 14 may be provided with a threaded coupling member 32 at its open end for threaded connection with a suitable threaded mating connector 34 provided at the inlet end 36 of housing 24. It should be appreciated, however, that any number of suitable means may be provided for releasably attaching the filter assembly 10 to hose 14.

Housing 24 has an elongate, tubular body with a cylindrical side wall 40 extending between inlet end 36 and an opposite end 38. A plurality of fluid passageways 42 located along substantially the entire length of side wall 40 are provided for radial discharge of the water through the filter contained within the housing. The housing 24 preferably is made from a noncorrosible material such as molded plastic.

An important aspect of the invention is the provision of an underlying section 44 of filter removal element 26 which underlies the filter 28, as can best be seen in FIG. 3. The section 44 is circular, conforming to the cylindrical shape of the inside of housing 24, and has a diameter slightly less than that of the inside diameter of cylindrical housing 24 so that it may be slidably received therewithin. The filter removal element 26 also includes an elongate stem 48 attached to section 44 and extending therefrom in a normal direction from its center to a free end 50.

As seen in FIG. 3, the length of stem 48 relative to the length of housing 24 is such that when section 44 is adjacent end 38, free end 50 is located adjacent open end 36. The stem, when inserted within housing 24, is therefore manually accessible through the open end 36 for withdrawal of removal element 26. When removal element 26 is withdrawn, the underlying section carries the filter element 28 out of housing 40.

In keeping with one of the objects of the invention, section 44 serves a dual function. It not only carries the filter element 28 out of the housing for cleaning when stem 48 is withdrawn, but also functions as a closure for end 38 of the housing. The closure of end 38 is necessary to create a back pressure so that the water flows outwardly from the central portion of housing 24 through filter element 28 and fluid passageways 42 as illustrated by arrows 70. Accordingly, the diameter of section 44 is only slightly less than the inside diameter of housing 24 for a snug fit therewith. The need for a separate closure for end 38, such as a cap 68 illustrated in broken line in FIG. 3, is eliminated, and the structure of the housing is simplified and its cost reduced. It should be appreciated that the spacing between section 44 and housing 24, as shown in FIG. 3, is greater than that contemplated for the actual structure for purposes of clarity and illustration.

Connector plate 30 has a center projection 54 and a threaded, center hole 52 extending therethrough. The free end 50 of stem 48 extends into, and is threaded for releasable, threaded connection with, the threaded center hole 52. The connector plate 30 is screwed down onto stem 48 such that the filter element 28 is sandwiched between the underlying section 44 and the peripheral edge 58 of connector body 56. The length of the threaded portion at end 50 of stem 48 is greater than the length of threaded hole 52 to accommodate for slight variation in the length of filter element 28. This also permits some adjustment in the location of section 44 relative to end 38 of housing 24.

Referring to FIG. 4, the connector plate 30 also includes a disc-shaped body 56. Body 56 is threaded around its peripheral edge 58 for being threadably secured to body 24 at inlet end 36. Center projection 54 is hexagonal in shape, and protrudes out of the inlet end of housing 24. The center projection 54 is thereby manually engageable by a wrench to facilitate disconnection of both the connector plate 30 and the stem 48 from the housing 24.

Extending radially from center projection 54 are four spokes 60 defined by four quadrantly spaced openings 62 extending through the body. Openings 62 allow the water to flow from the end of discharge hose 14 into the central portion of housing 24, as indicated by arrows 64, FIG. 3.

Referring to FIG. 5, another important feature of the present invention is the provision of a filter element 28 comprised of a resilient sheet of suitable filter material, such as plastic mesh which, when in an unflexed state as shown in broken line in FIG. 5, is in a substantially noncylindrical configuration. The filter element 28 has a width dimension W substantially equal to, but less than, the circumference of underlying section 44, and a length equal to the distance between the underside of connector plate 30 and section 44. In this substantially planar configuration, the filter element 28 may be readily cleaned by a backflushing process or the like. Another advantage is that substantially less volume is taken by the filter element 28 when in its planar configuration than when in its cylindrical configuration during shipping. The cost of manufacturing the planar filter relative to a filter element which is always held in a cylindrical configuration is, of course, also reduced.

The filter 28 is manually turned upon itself to place it into a cylindrical configuration, as indicated by the solid line illustration of FIG. 5, and then inserted into the housing 24. Once inserted, the sheet of material is constrained against returning to its noncylindrical configuration by the housing side walls, and its resilience causes it to be pressed against the side wall 40 for a snug fit therewith.

I claim:

1. A filter assembly for removing lint from water discharged through a hose from a washing machine, comprising:

an elongate tubular housing having an inlet end releasably connectable with the hose, another end opposite the inlet end, and a side wall extending between the opposite ends, said side wall having a plurality of fluid passageways for discharging water along the length thereof:

an elongate tubular filter element located within the body; and a filter removal element within the body, said removal element having a section underlying the filter element adjacent the other end of the body, in loose supportive engagement therewith, said section being substantially coextensive with and having a shape conforming to that of the inside of the housing to substantially close the other end for causing the discharge water to exit through the filter element along the length of the housing, and an elongate stem extending from the section through the filter element to adjacent the open end, said stem being manually accessible through the open end of the body for withdrawal of the removal element from the body, said underlying section carrying the filter element out of the body when the filter removal element is withdrawn.

2. The filter assembly of claim 1 including means for releasably securing an end of the stem spaced from the section to the housing with said one end of the stem at an elongate center axis of the housing, an end of the stem opposite the one end being held at said center axis by said section whereby the stem is coaxial with the housing.

3. The filter assembly of claim 2 in which said releasably securing means includes a connector having means for releasably attaching the stem to the connector and means for releasably securing the connector to the housing adjacent said inlet end.

4. The filter assembly of claim 3 in which said connector is a plate, said plate overlying the filter element and having openings therethrough for the flow of discharge water from the hose to the interior of the filter element.

5. The filter assembly of claim 4 in which said releasably securing means includes means for threadably securing the connector with the housing, said releasably attaching means includes means for threadably attaching the stem to the connector, and said connector includes a manually engageable projection protruding out of the open end of the body to facilitate manual detachment of the connector from the housing.

6. The filter assembly of claim 4 in which said filter element is sandwiched between the underlying section of the filter removal element and the plate.

7. The filter assembly of claim 1 in which said housing is the outermost member of the assembly.

8. The filter assembly of claim 1 in which said filter element comprises a resilient sheet of filter material, said sheet being constrained into a cylindrical configuration when within the housing and resiliently returning to a noncylindrical configuration when the constraint of the housing is removed.

* * * * *